US007672835B2

(12) United States Patent
Setoguchi

(10) Patent No.: US 7,672,835 B2
(45) Date of Patent: Mar. 2, 2010

(54) VOICE ANALYSIS/SYNTHESIS APPARATUS AND PROGRAM

(75) Inventor: Masaru Setoguchi, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 1080 days.

(21) Appl. No.: 11/311,678

(22) Filed: Dec. 19, 2005

(65) Prior Publication Data

US 2006/0143000 A1 Jun. 29, 2006

(30) Foreign Application Priority Data

Dec. 24, 2004 (JP) ..... 2004-374090

(51) Int. Cl.
*G10L 19/14* (2006.01)

(52) U.S. Cl. ..... 704/205; 704/207; 704/238; 704/268

(58) Field of Classification Search ..... 704/205, 704/207, 238, 268
See application file for complete search history.

(56) References Cited

U.S. PATENT DOCUMENTS

2005/0065784 A1* 3/2005 McAulay et al. ..... 704/205

FOREIGN PATENT DOCUMENTS

JP 05-143088 A 6/1993
JP 09-062257 A 3/1997
JP 2001-117600 A 4/2001

OTHER PUBLICATIONS

Japanese Office Action dated Jun. 30, 2009 and English translation thereof issued in a counterpart Japanese Application No. 2004-374090.

* cited by examiner

*Primary Examiner*—David R Hudspeth
*Assistant Examiner*—Jakieda R Jackson
(74) *Attorney, Agent, or Firm*—Frishauf, Holtz, Goodman & Chick, P.C.

(57) ABSTRACT

An FFT unit performs an FFT process on high-frequency-eliminated, pitch-shifted voice data for one frame. A time scaling unit calculates a frequency amplitude, a phase, a phase difference between the present and immediately preceding frames, and an unwrapped version of the phase difference for each channel from which the frequency component was obtained by the FFT, detects a reference channel based on a peak one of the frequency amplitudes, and calculates the phase of each channel in a synthesized voice based on the reference channel, using results of the calculation. An IFFT unit processes each frequency component in accordance with the calculated phase, performs an IFFT process on the resulting frequency component, and produces synthesized voice data for one frame.

10 Claims, 12 Drawing Sheets

VOICE ANALYSIS/SYNTHESIS APPARATUS AND PROGRAM

CROSS-REFERENCE TO RELATED APPLICATION

This application is based upon and claims the benefit of priority from the prior Japanese Patent Application No. 2004-374090 filed on Dec. 24, 2004, entire contents of which are incorporated herein by reference.

BACKGROUND OF THE INVENTION

1. Field of the Invention

The present invention relates to voice analysis/synthesis apparatus that analyzes a voice waveform and synthesizes a voice waveform using a result of the analysis, and programs for control of the voice waveform analysis/synthesis.

2. Description of the Related Art

Some of voice analysis/synthesis apparatus that analyze a voice waveform and synthesize another voice waveform using result of the analysis analyze the frequencies of the former voice waveform as its analysis. In such apparatus, synthesis of a voice waveform mainly comprises analysis, modification and synthesis processes, which will be described specifically.

<Analysis Process>

A voice waveform is sampled at predetermined intervals of time. A predetermined number of sampled waveform values constitute a frame which is then subjected to short-time Fourier transform (STFT), thereby extracting a frequency component for each different frequency channel. The frequency component includes a real part and an imaginary part. The frequency amplitude (or formant component) and phase of each frequency channel are calculated from its frequency component. STFT comprises extracting signal data for a short time and performing discreet Fourier transform (DFT) on the extracted signal data. Thus, the DFT is used as including STFT. As DFT, Fast Fourier transform (FFT) is generally used.

Pitch scaling including shifting a pitch of the voice waveform is performed after the extracted frame is interpolated/extrapolated or thinned out, and then resulting data is subjected to FFT.

<Modification Process>

Since DFT (or FFT) of the voice waveform is performed in units of a frame, a synthesized voice waveform is also obtained in units of a frame. Phase $\theta'_{i,k}$ of frequency channel k in the synthesized voice waveform is calculated in a following expression (1). When only time scaling including changing a voice duration time is performed, the frequency amplitude of each frequency channel need not be changed.

$$\theta'_{i,k}=\theta'_{i-1,k}+\rho\cdot\Delta\Theta_{i,k} \tag{1}$$

where $\Delta\Theta_{i,k}$ represents a phase difference in the frequency channel k between the present and preceding frames of the voice waveform, and ρ represents a scaling factor indicative of an extent of pitch scaling. Subscript i represents a frame. The present and preceding frames are represented by i and i−1, respectively. Thus, expression (1) indicates that phase $\theta'_{i,k}$ of frequency channel k in the present frame of the synthesized voice waveform is calculated by adding the product of phase difference $\Delta\Theta_{i,k}$ and factor ρ to the phase of the frequency channel of the preceding frame in the synthesized voice waveform section (or the accumulated phase difference converted according to scaling factor ρ).

Phase difference $\Delta\theta_{i,k}$ need be unwrapped. In the voice waveform synthesis, unwrapping and wrapping the phase have an important meaning, which will be described below in detail. In order to easily recognize whether a phase is wrapped or unwrapped, the wrapped and unwrapped phases are represented by lower-case and capital letters θ and Θ, respectively.

Phase $\theta_{k,t}$ of any channel k at any particular time t is represented by $$\theta_{k,t}=\int_0^t\omega_k(\tau)d\tau+\theta_{k,0} \tag{2}$$

As will be obvious from expression (2), phase $\theta_{k,t}$ is obtained by integrating an angular velocity $\omega_k$. A value obtained as the arctan when the phase is calculated based on the frequency component calculated by DFT is limited to between −π and π, or obtained as a wrapped phase $\theta_{k,t}$. Thus, a term of 2nπ is missing which is contained in phase $\Theta_{k,t}$ represented by $$\Theta_{k,t}=\theta_{k,t}+2n\pi \text{ where } n=0, 1, 2, \tag{3}$$

In order to calculate phase θ' k,t from expression (1), wrapped phase need be unwrapped, which is work for presuming n in expression (3) and presumable based on the central frequency of channel k of DFT.

$$\Delta\theta_{i,k}=\theta_{i,k}-\theta_{i-1,k} \tag{4}$$

where $\Delta\theta_{i,k}$ in expression (4) indicates a phase difference in the wrapped phase $\theta_{i,k}$ of channel k between adjacent frames. Central frequency $\Omega_{i,k}$ (or angular velocity) of channel k is obtained by $$\Omega_{i,k}=(2\pi\cdot fs/N)\cdot k \tag{5}$$

where fs is a sampling frequency and N is DFT's order. Phase difference $\Delta Z_{i,k}$ is calculated from $$\Delta Z_{i,k}=\Omega_{i,k}-\Delta t \tag{6}$$

where Δt is the difference in time between the present and preceding frames at frequency $\Omega_{i,k}$. Time difference Δ t itself is obtained from $$\Delta t=N/(fs\cdot OVL) \tag{7}$$

where OVL in expression (7) represents an overlap factor that comprises a value obtained by dividing the frame size by a hop size (or the number of sampling operations corresponding to a discrepancy between adjacent frames).

Expression (6) indicates that the phase is unwrapped, and can be expressed as $$\Delta Z_{i,k}=\Delta\zeta_{i,k}+2n\pi \tag{8}$$

Let $\delta$ $(=\Delta\theta_{i,k}-\Delta\zeta_{i,k})$ be a difference between a phase difference $\Delta\theta_{i,k}$ calculated in expression (4) and a phase difference $\Delta\zeta_{i,k}$ in expression (8). Then $$\begin{aligned}\Delta\theta_{i,k}\cdot\Omega_{i,k}\cdot\Delta t &= (\Delta\zeta_{i,k}+\delta)-(\Delta\zeta_{i,k}+2n\pi)\\ &= \delta-2n\pi\end{aligned} \tag{9}$$

Thus, δ can be calculated by deleting the right term, 2n π, of expression (9) and limiting the range of expression (9) to between −π and π, and represents an actual phase difference detected in the original voice waveform.

By adding phase difference $\Delta Z_{i,k}$ ($=\Omega_{i,k}\cdot\Delta t$) to the actual phase difference δ, a phase difference $\Delta\Theta_{i,k}$ can be obtained which is phase unwrapped as follows:

$$\Delta\Theta_{i,k}=\delta+\Omega_{i,k}\cdot\Delta t=\delta+(\Delta\zeta_{i,k}+2n\pi)=\Delta\theta_{i,k}+2n\pi \quad (10)$$

Time-scaled phase $\theta'_{i,k}$ is calculated from expressions (1) and (10). Note that in the method of phase wrapping based on the central frequency of the channel, actual phase difference δ need be $|\delta|<\pi$. Since the absolute value of a maximum value $\delta_{max}$ is a limit value over which no signal transfers to a next channel, $$\begin{aligned}|\delta_{\max}| &= (2\pi\cdot fs/N)\cdot(k+0.5)\cdot\Delta t-(2\pi\cdot fs/N)\cdot k\cdot\Delta t \\ &= (2\pi\cdot fs/2N)\cdot(N/fs\cdot OVL))=\pi/OVL\end{aligned} \quad (11)$$

The value of overlap factor OVL is OVL>1 based on expression (11) and a relationship $|\delta|<\pi$. Thus, it will be known that the frames need be overlapped for phase unwrapping.

In DFT, a signal in one channel generally excites a plurality of other channels. Then, when a complex sinusoidal wave fn having an amplitude of 1, a normalized angular frequency ω and an initial phase ϕ is not applied as a window function (or when a square window is applied as a window function), the DFT is given by $$F_k=\frac{\sin\frac{N\varpi}{2}}{\sin\frac{\varpi}{2}}e^{-j\{(N-1)\frac{\varpi}{2}-\phi\}}\left(\varpi=-\omega+\frac{2\pi}{N}k\right) \quad (12)$$

The complex sinusoidal wave fn can be expressed as $$f_n=e^{j(\omega n+\phi)}$$

It will be understood from expression (12) that all the channels whose angular frequencies are other than the angular frequency $\omega=2\pi|N)\cdot k$ are excited. Since some window function is usually used, the number of channels excited depending on the bandwidth of that window function changes. When a Hanning window is used as the window function, the DFT value is given by $$W_0=(1/2)N,\ W_1=-(1/4)N,\ W_{-1}=-(1/4)N \quad (13)$$

This is then wrapped into each channel. As will be obvious from expression (13), even when the angular frequency is $\omega=(2\pi|N)\cdot k$, three channels are excited at a ratio in frequency amplitude value of 1:2:1. When the angular frequency ω is between those in adjacent channels, four channels are excited at a ratio in frequency amplitude value of 1:5:5:1.

In order to unwrap the phase correctly in every channel to be excited, n in expression (8) must have the same value in all the channels to be excited. This restriction requires that when a Hanning window is applied as a window function to the frame, the value of overlap factor OVL need be 4 or more.

In the above analysis process, a frame is extracted in accordance with overlap factor OVL having such value, and the window function is applied to the frame, which is then subjected to FFT. In the modification process, the phase of the channel calculated as above is maintained while the frequency amplitude of each channel is operated as required.

<Synthesize Process>

In the synthesis process, the frequency component modified (or operated) in the modification process is restored to a signal on the time coordinate by IFFT (Inverse Fast Fourier Transform), thereby producing a synthesized voice waveform section for one frame, which is then caused to overlap with the preceding-frame waveform section depending on a value of overlap factor OVL that will be changed in accordance with the value of factor ρ, thereby producing a synthesized, pitch-scaled and time-scaled voice waveform.

With the conventional voice analysis/synthesis apparatus that obtains a synthesized voice waveform in the manner mentioned above, a synthesized sound involving the synthesized voice waveform will undesirably give a listener an impression of phase discrepancy, called phasiness or reverberant against an original sound based on the original sound waveform. More particularly, this phase discrepancy will cause the listener to feel that a source of the synthesized sound is remoter than that of the original sound, thereby exerting a bad influence undesirably on the listener's auditory sense. This will occur even when the pitch shift is very small. Now, this will be described in detail next.

As described above, the frames need be overlapped to unwrap the phase correctly. If to this end an appropriate value is set to the overlapping factor OVL to be used, the phase can be unwrapped correctly. Thus, the second term of the right side of expression (1) ensures that the phase $\theta'_{i,k}$ calculated from expression (1) always has coherence concerning a phase on the time base. Hereinafter, coherence of phase $\theta'_{i,k}$ on the time base is referred to as HPC (Horizontal Phase Coherence) whereas coherence of phase between channels or frequency components is referred to as VPC (Vertical Phase Coherence).

The conventional voice analysis/synthesis apparatus gives the listener the impression of phase discrepancy because the VPC is not preserved. The causes why the VPC is not preserved is that the first term of the right side of expression (1) cannot have a correct value. Let a phase unwrapping factor be n. Then, expression (1) can be modified as follows, using expressions (4) and (10):

$$\theta'_{i,k}=\theta'_{i-1,k}+\rho(\theta_{i,k}-\theta_{i-1,k}+2n\pi) \quad (14)$$

Now, assume that the value of scaling factor ρ is an integer. Then, a phase unwrapping term of 2nπ included in the right side of expression (14) is deletable and expression (14) can be expressed as:

$$\begin{aligned}\theta'_{i,k} &= \theta'_{i-1,k}+\rho(\theta_{i,k}-\theta_{i-1,k})= \\ &\theta'_{0,k}+\rho\sum_{j=1}^{i}(\theta_{j,k}-\theta_{j-1,k})=\theta'_{0,k}+\rho(\theta_{i,k}-\theta_{0,k})\end{aligned} \quad (15)$$

If initial phase $\theta'_{o,k}$ is set to $\rho\,\theta'_{o,k}$, expression (15) is expressed as:

$$\theta'_{i,k}=\rho\theta'_{i,k} \quad (16)$$

Thus, the first term of the right side of expression (1) is erased. Hence, both HPC and VPC are preserved, thereby bringing about scaling giving no impression of phase discrepancy. However, if scaling factor ρ has a value other than an integer, the first term of the right side of expression (1) will remain.

The first term of the right side of expression (1) comprises an accumulated converted value ($=\rho\cdot\Delta\Theta_{i,k}$) of the phase difference unwrapped. In order to continue to maintain the converted value at a correct value, it is necessary to appropriately cope with the following points appropriately:

1) Influence of the initial phase value,

2) Transition of a frequency component between channels, and

3) Disappearance/production of a frequency component.

With reference to point 1), the accumulated converted value can be maintained at a correct value by setting initial phase $\theta'_{o,k}$ to $\rho\,\theta'_{o,k}$ as described above.

With reference to point 2), if (a) a channel in which the frequency component is present is tracked, using the method of picking a peak one of the frequency amplitudes, (b) it is detected that the frequency component has transited from its present channel to another channel, and then (c) a phase difference over channels is calculated, the accumulated converted value can be maintained at a correct value. When the frequency component (or signal) has transited from channel k to channel k+1, expression (14) can be modified as:

$$\theta'_{i,k+1}=\theta'_{i-1,k}+\rho(\theta_{i,k+1}-\theta_{i-1,k}+2n\pi) \quad (17)$$

Phase unwrapping factor n is also calculated using phase $\Omega_{i,k+1}$. When tracking the transition of the frequency component fails, the accumulated converted value at this time would be inaccurate, thereby not maintaining the VPC. When transition of a frequency component between channels occurs in a frame, a situation can occur in which there is no channel in the immediately preceding frame corresponding to the channel in the present frame from which the transition of the frequency component occurred. In this case, an accurate accumulated converted value cannot be obtained due to channel discrepancy.

With reference to point 3), the disappearance/production of the frequency components are considered as inevitable in general voices and/or musical sounds excluding special voices whose waveforms comprise, for example, standing ones. Since disappearance/production of frequency components will occur randomly and very often, especially in noise having no harmonic structure, it is materially impossible to detect and hence avoid them.

Thus, maintaining VPC is materially impossible excluding that the value of scaling factor ρ is an integer in the conventional voice analysis/synthesis apparatus. Hence, it is impossible to surely avoid synthesis of a voice waveform that will give an impression of phase discrepancy. Therefore, it has been desired to surely avoid synthesis of a voice waveform that will give the impression of phase discrepancy.

In the voice analysis/synthesis apparatus disclosed in Japanese Patent 2753716 publication, the phase of a pitch-changed synthesized voice waveform is controlled in accordance with an extent of frame overlapping, which is performed in the synthesis process. The reason why the accumulated converted value, or first term of the right side of expression (1), cannot have a correct value is that that phase control is performed.

SUMMARY OF THE INVENTION

It is therefore an object of the present invention to provide a voice analysis/synthesis apparatus that securely avoids synthesis of a voice waveform that would give an impression of phase discrepancy, and a program to be used for control of the apparatus.

According to one aspect of the present invention, the frequencies of the first voice waveform are analyzed in units of a frame and a frequency component is extracted for each frequency channel. A phase difference in a frame between the first and second voice waveforms is calculated, the frame preceding the present frame by a predetermined number of frames, with a predetermined one of the frequency channels as a standard. A phase of the second voice waveform in the present frame is calculated for each frequency channel, using the phase difference. A formant of the first voice waveform is extracted from the frequency components each extracted from a respective frequency channel. The frequency components are operated to shift the extracted formant. A frequency component is converted for each frequency channel in accordance with the calculated phase. Then, the second voice waveform is synthesized in units of a frame, using the converted and operated frequency component.

By creating a phase difference in a frame between the first and second voice waveforms preceding the present frame by a plurality of frames, the phases of the respective frequency channels of the second voice waveform can be expressed relatively with a predetermined frequency channel as a standard. Thus, the relationship in phase between the frequency channels is maintained appropriate at all times, thereby avoiding synthesis of the second voice waveform that would otherwise give an impression of phase discrepancy. Since the phase difference involves the frame preceding the present frame by a plurality of frames, a bad influence of a possible error occurring in any one of the frequency channels before the preceding frame on synthesis of the second good voice waveform is avoided or reduced, thereby ensuring synthesis of the second good voice waveform at all times.

According to the invention, the formant of the first voice waveform is extracted from the frequency components each extracted for a respective frequency channel, and then the frequency components are operated to shift the extracted formant. The second voice waveform is then synthesized, using the converted and operated frequency components. Thus, the formant of the second voice waveform can be shifted as required, thereby allowing the formant of the first voice waveform to be preserved. Thus, in this case, the second voice waveform will give not an impression of phase discrepancy but an impression of a natural voice.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE INVENTION

First Embodiment

Figure 1:
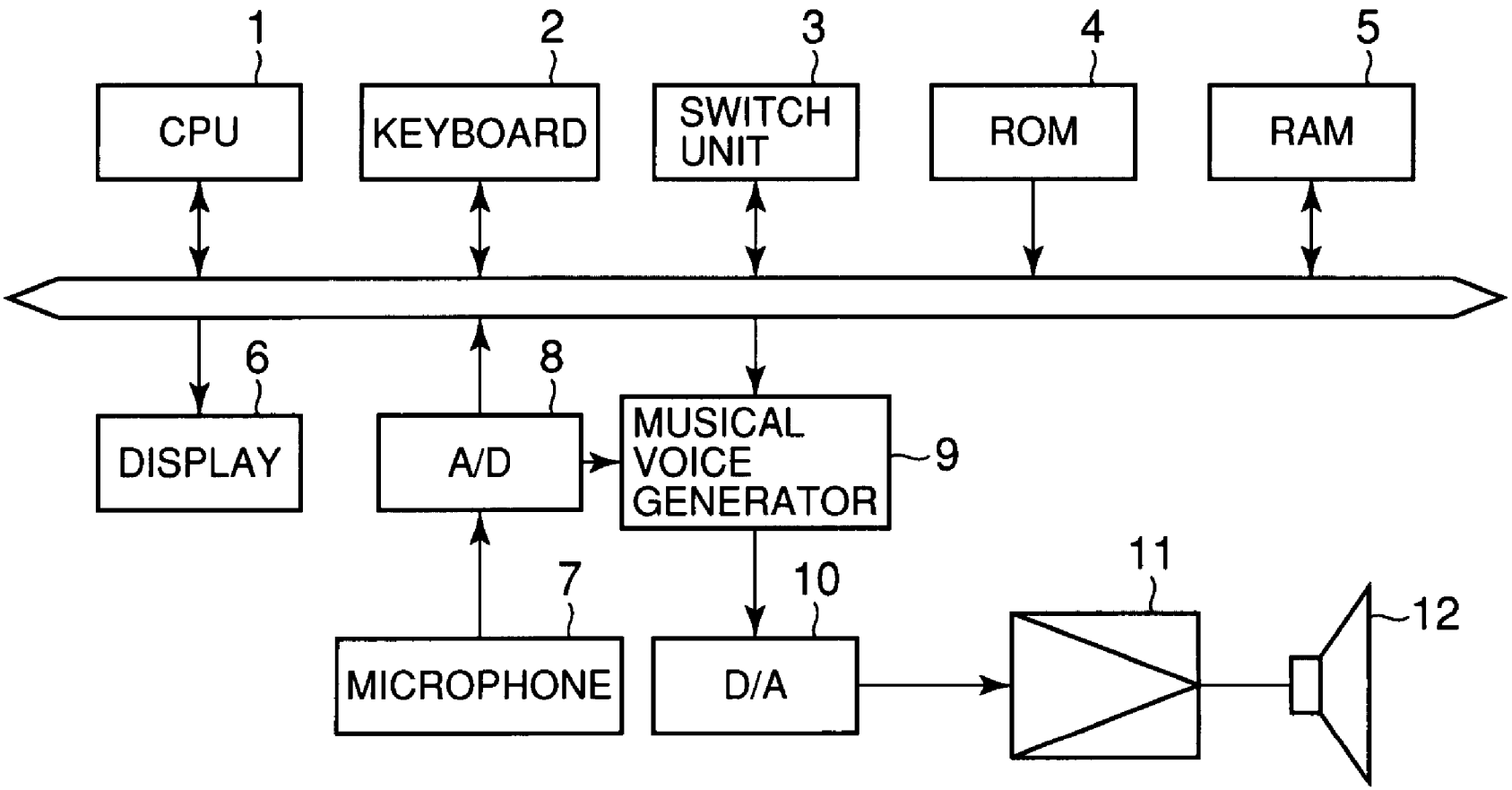
FIG. 1 illustrates the structure of an electronic musical instrument including a voice analysis/synthesis apparatus as a first embodiment of the present invention.

Referring to FIG. 1, an electronic musical instrument including a voice analysis/synthesis apparatus according to the first embodiment of the invention comprises CPU 1 that controls the whole instrument, keyboard 2 including a plurality of keys, switch unit 3 including various switches, ROM 4 that has stored programs to be executed by CPU 1 and various control data, RAM 5 including a working area for CPU 1, display unit 6 comprising, for example, a liquid crystal display (LCD) and a plurality of light emitting diodes (LEDs), A/D converter 8 that performs A/D conversion on an analog voice signal received from microphone 7 and outputs resulting voice data, musical-sound generator 9 that generates musical sound waveform data in accordance with instructions from CPU 1, D/A converter 10 that performs D/A conversion on waveform data generated by musical-sound generator 9 and outputs an analog audio signal, amplifier 11 that amplifies the audio signal, and speaker 12 that converts the amplified audio signal to a sound. CPU 1, keyboard 2, switch unit 3, ROM 4, RAM 5, display 6, A/D converter 8, and musical-sound generator 9 are connected by bus. Switch unit 3 further includes a detector (not shown) that detects changes in the status of each switch in addition to the various switches that will be operated by the user.

The voice analysis/synthesis apparatus of the electronic musical instrument is implemented as giving a voice signal received from microphone 7 an audio effect that shifts the pitch of the voice signal to a specified one. A signal such as the voice signal from microphone 7 may be received via an external storage device, a LAN or a communications network such as a public network.

Figure 2:
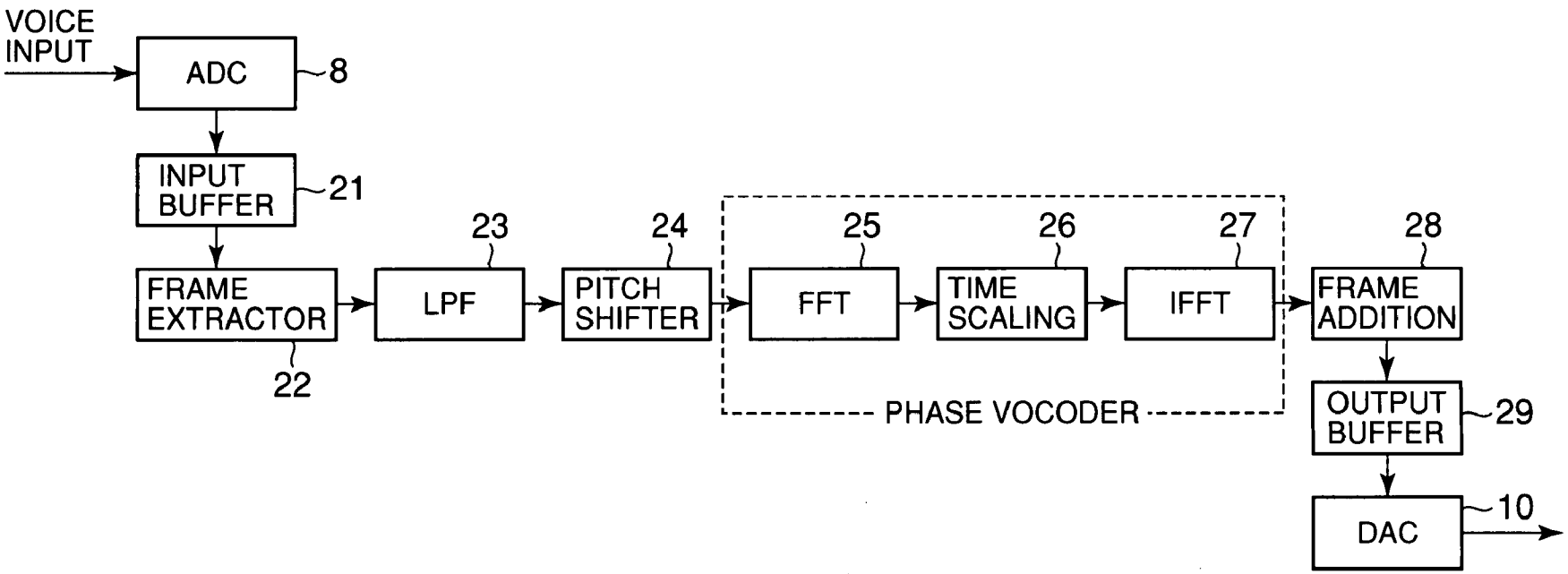
FIG. 2 illustrates a functional structure of the voice analysis/synthesis apparatus.

Referring to FIG. 2, a voice waveform to which an audio effect is added, or a pitch-shifted voice waveform, is obtained by analyzing the frequencies of the original voice waveform, extracting a frequency (or spectrum) component for each frequency channel, shifting the extracted frequency component, and synthesizing the shifted frequency components into voice waveform data. To this end, the apparatus has the following functional structure.

FIG. 2 shows A/D converter (ADC) 8 that samples an analog voice signal from microphone 7, for example, at a sampling frequency of 22,050 Hz and then converts the sampled data to digital voice data of 16 bits.

Input buffer 21 temporarily stores voice data outputted from A/D converter 8. Frame extractor 22 extracts frames of voice data having a predetermined size from the voice data stored in input buffer 21. The size of each frame comprises, for example, 1,024 items of sampled voice data. In order to perform a phase unwrapping correctly, the voice data need be extracted in a manner in which the frames overlap with overlap factor OVL of 4. In this case, the hop size is 256 (=1024/4).

One-frame voice waveform data extracted by frame extractor 22 is provided to low pass filter (LPF) 23, which eliminates high frequency components of the frame voice waveform data to prevent its frequency components from exceeding the Nyquist frequency due to the pitch shift. Pitch shifter 24 interpolates/extrapolates or thins out the frame voice waveform data received from LPF 23 in accordance with pitch scaling factor ρ, thereby shifting the pitch. To this end, a general Lagrange's function and a sinc function may be used. In the embodiment, pitch shift (or pitch scaling) is performed, using Neville's interoperation/extrapolation formula.

FFT unit 25 performs an FFT operation on pitch-shifted frame voice waveform data. Time scaling unit 26 performs a time scaling operation on the frequency component of each frequency channel obtained in the FFT operation, thereby calculating the phase of a synthesized voice waveform in the frame. IFFT unit 27 performs an IFFT (Inverse FFT) operation on the time-scaled frequency component of each frequency channel, thereby restoring all those frequency components to synthesized voice data for one frame on corresponding time coordinates, thereby outputting the data. FFT unit 25, time scaling unit 26 and IFFT unit 27 compose a phase vocoder.

Output buffer 29 will store synthesized voice data that produces a voice that will be let off from speaker 12. Frame addition unit 28 adds synthesized voice data for one frame, received from IFFT unit 27, in an overlapping manner to synthesized voice data stored in output buffer 29. Then, resulting synthesized voice data in output buffer 29 is subjected to D/A conversion by D/A converter (DAC) 10.

Figure 6:
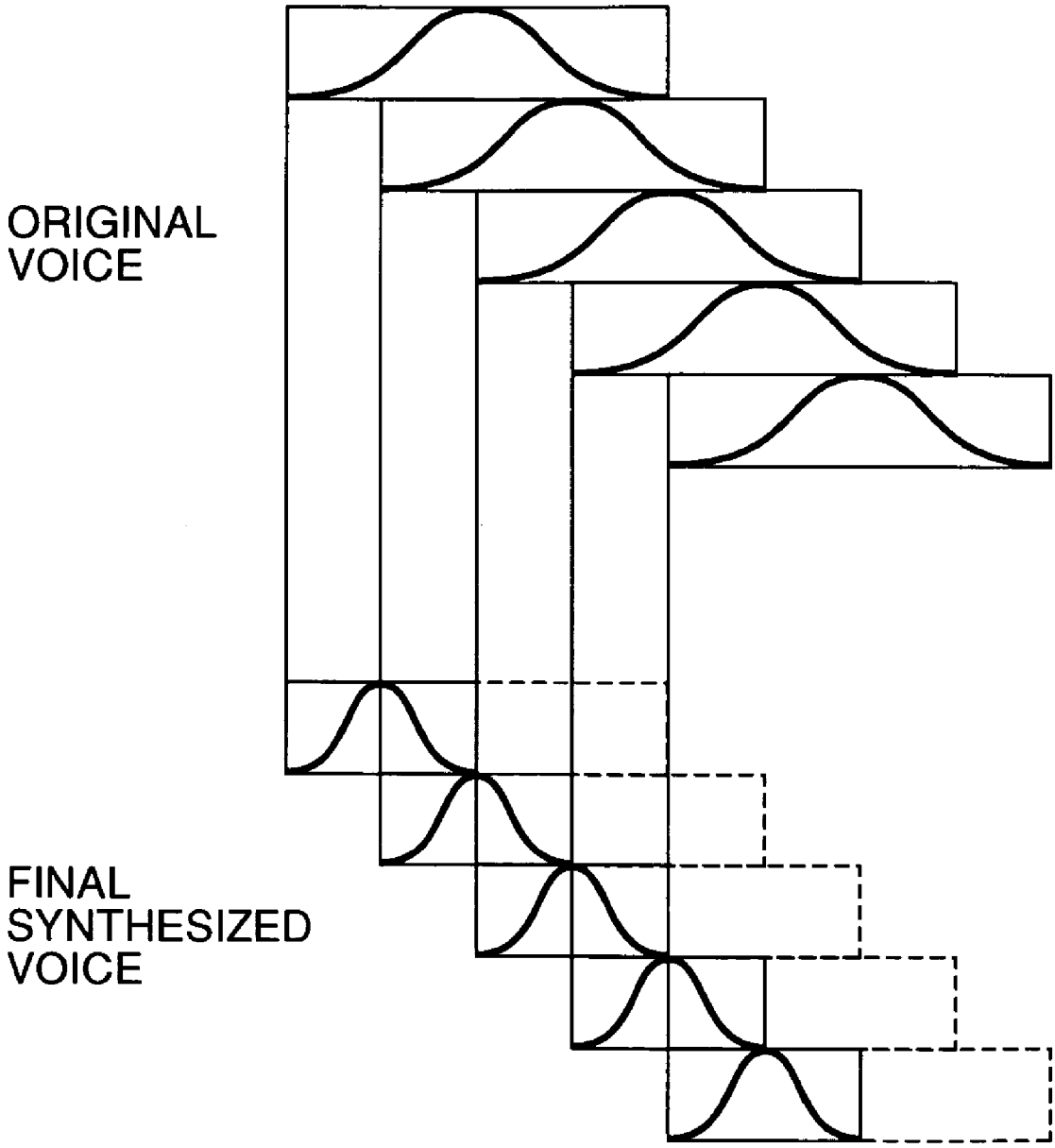
FIG. 6 illustrates an overlapping addition to be performed on a synthesized voice waveform.

When the value of scaling factor ρ is 2, or, the pitch is doubled, pitch shifter 24 thins out the frame data, thereby reducing the frame size to ½. Thus, if the value of overlap factor OVL remains unchanged, the size of the synthesized voice waveform stored in output buffer 29 becomes approximately ½ of the size of the unthinned original voice waveform. Thus, as shown in FIG. 6 the synthesized voice waveform is added to the voice waveform of the preceding frame in an overlapping manner with ½ of the value of overlap factor OVL (here, 2).

Input and output buffers 21 and 29 are provided, for example, in RAM 5. Frame extractor 22, LPF 23, pitch shifter 24, FFT 25, time scaling unit 26, IFFT 27, and frame adder 28 are implemented by CPU 1 that executes the relevant programs stored in ROM 4, using RAM 5, for example, as a working area excluding A/D converter 8, D/A converter 10, input buffer 21 and output buffer 29. Although not described in detail, a quantity of pitch shift is given at keyboard 2 and an extent of time scaling is given by operating a predetermined switch of switch unit 3, for example.

In the embodiment, phase θ' of each frequency channel in a synthesized voice is calculated by:

$$\theta'_{i,k}=(\Delta\Theta_{i,k}/\Delta\Theta_{i,B})(\theta'_{i-1,B}-\Theta_{i-1,B})+(\rho-1)\Delta\Theta_{i,k}+\theta_{i,k} \quad (18)$$

where subscript B indicates a channel where the longest-waveform, or shortest frequency, component is present, and a first term of the right side of expression (18) indicates a quantity of change in the phase between original and synthesized voice signals and having occurred while the original and synthesized voice signals moved from frame 1 to frame i−1, with channel B as a reference. A second term indicates a quantity of change in the phase between the original voice and the synthesized voice and having occurred while the original and synthesized voices moved from the preceding frame i−1 to the present frame i. Thus, expression (18) indicates calculation of phase θ' of each channel in a synthesized voice by adding the quantity of change in the phase having occurred over the range of from frame 1 to frame i−1 to phase θ in present frame i.

The first and second terms of the right side of expression (18) are for maintaining the VPC and the HPC, respectively, which will be described specifically next.

When phase θ [rad] is divided by angular velocity ω [rad/sec], a resulting unit is time [sec]. When this unit is multiplied by sound velocity ν [m/sec], a resulting unit is distance [m], which will be used to described a phase (including phase difference).

Figure 3:
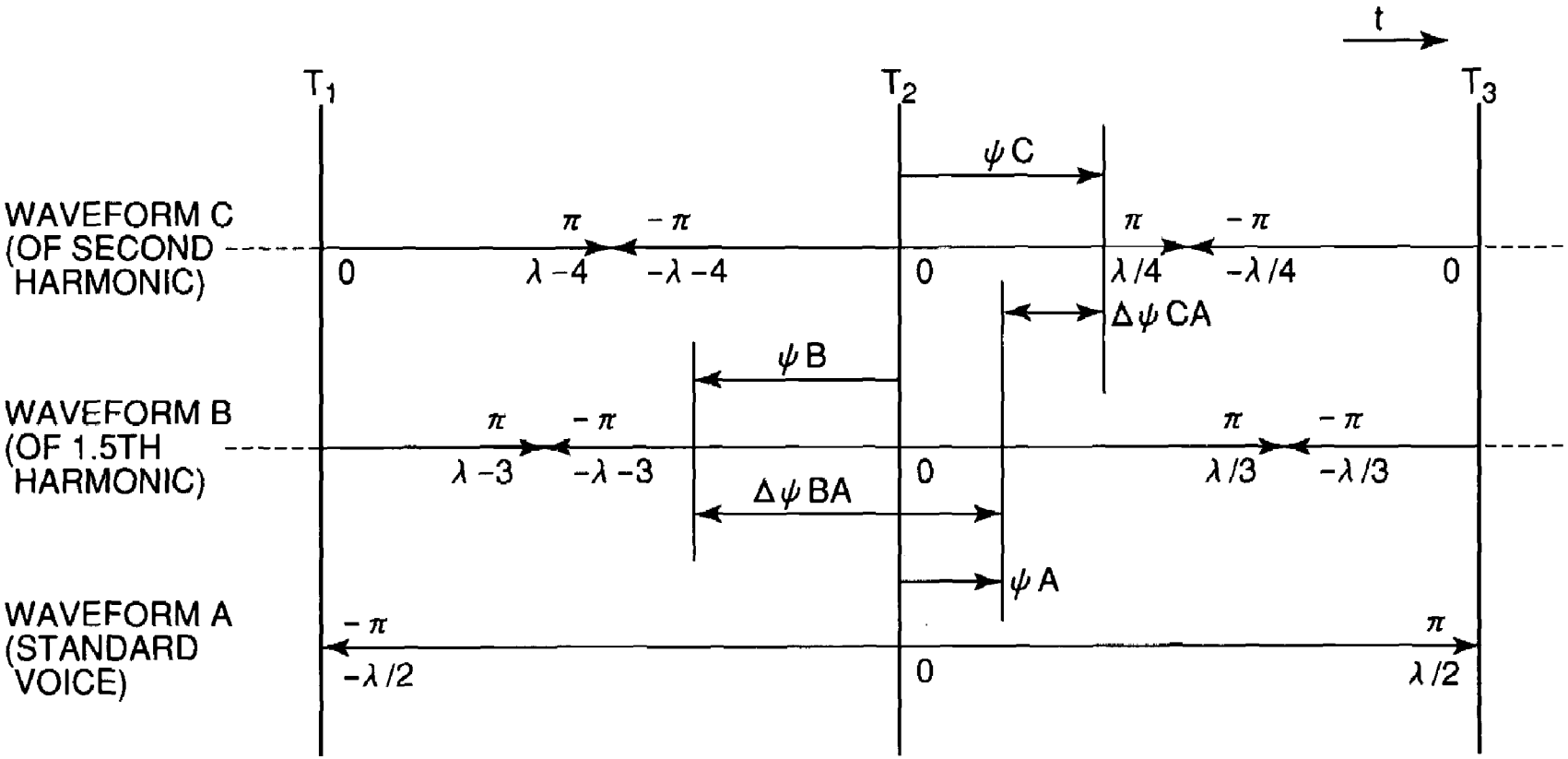
FIG. 3 illustrates a relationship in the phase between frequency components.
Figure 4:
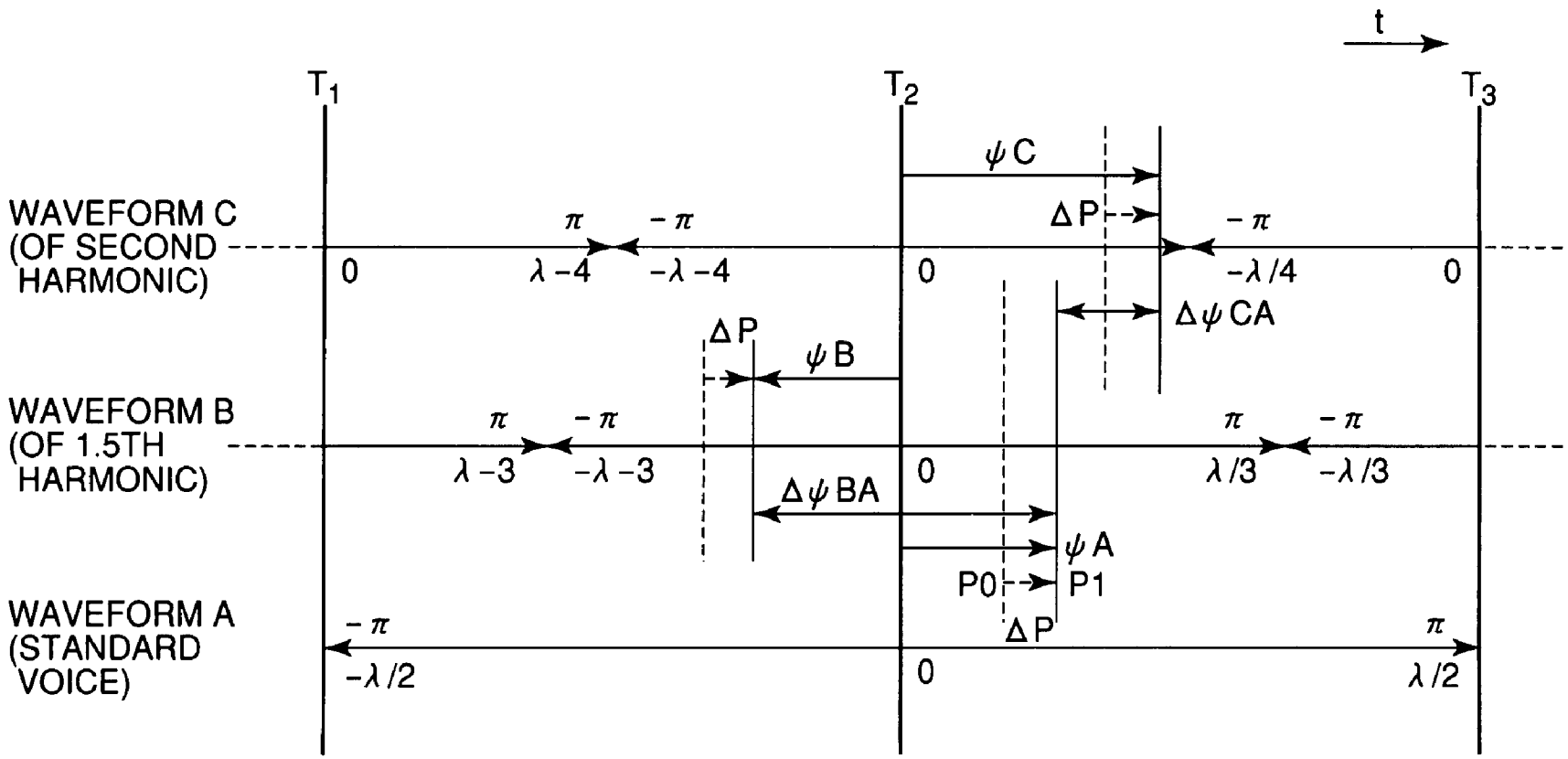
FIG. 4 illustrates another relationship in the phase between frequency components.

Referring to FIGS. 3 and 4 that illustrate VPC, waveform A (of a reference voice) involves a frequency whose phase changes by π in each of time durations $T_1$-$T_2$ and $T_2$-$T_3$. Thus, the corresponding distances are ½ of waveform λ of waveform A (=λ/2). Waveforms B and C have frequencies that are 1.5 and 2 times, respectively, that of waveform A. Times $T_1$, $T_2$ and $T_3$ are used to illustrate positions and phase changes on the waveforms for convenience' sake.

In FIG. 3, the respective phases of waveforms A-C are indicated by corresponding distances with time $T_2$ as a reference point. The phase of waveform A is present at a position distant by a distance ΨA in a positive direction from the reference point. Likewise, the phases of waveforms B and C are present at positions distant by distances ΨB and ΨC in negative and positive directions, respectively, from the reference point. The distances are calculated from the corresponding phases, which in turn are calculated from the related arctans, and hence wrapped. Thus, any distance has a length that does not exceed one wavelength.

ΔΨBA and ΔΨCA in FIG. 3 indicate relative distances for the phase between wavelengths B and A and between wavelength C and A, respectively. Thus, ΔϕBA and ΔΨCA are obtained as ΔΨBA=ΨB −ΨA, and ΔΨCA=ΨC−ΨA, respectively. These relative distances for the phase are hereinafter referred to as relative phase distances.

VPC corresponds to maintenance of such relative phase distances. More specifically, as shown in FIG. 4, when distance ΨA of waveform A changes from position P0 to position P1 by distance ΔP, distances ΨB and ΨC of waveforms B and C are caused to change by distance ΔP in the same direction following the change in the distance ΨA of waveform A, thereby maintaining the relative phase distances to waveform A constant.

By calculating the changing phases of waveforms B and C such that the relative phase distances are maintained, the VPC is maintained. As a result, producing synthesized voice data that would otherwise give an impression of phase discrepancy, for example, due to phasiness, reverberation or loss of presence is securely avoided at all times.

Since the phase of the voice waveform is calculated from the related arctan in the distance change of the voice waveform, this distance change need be accommodated within one wavelength. That is, when a distance in the phase between original voice and synthesized voice is calculated, their phases need be wrapped.

Now assume that in FIG. 4 waveform A moves by one wavelength λ into a next waveform section. Thus, the wrapped phase of waveform A is the same as before. This applies also to waveform C that comprises a second harmonic. However, the phase of waveform B that comprises a 1.5th harmonic is not have the same as before. When expressed in angle, a movement of the waveform A for one wavelength λ corresponds to a phase change of 360 degrees, and a movement of the waveform C for one wavelength λ corresponds to a change of 720 degrees. Thus, the changed waveforms A and C have the same wrapped phases as before. However, the movement of waveform B for one wavelength corresponds to a phase change of 540 degrees, so that the wrapped phase of waveform B is not the same as before.

As described above, harmonic waveforms having an integer and a non-integer times the fundamental frequency of a reference waveform have a different phase relationship in a different wavelength section. Thus, when the reference waveform shifts beyond a distance of one wavelength, a relative phase-distance relationship between waveforms excluding those having harmonics that are an integer times that of the reference waveform can never be maintained accurate. Thus, in order to maintain the phase relationship appropriate, the phase need be caused to move within one wavelength of the reference waveform. By providing these restrictions on the waveforms, the present invention can apply to not only waveforms having a harmonic structure, but also general voice waveforms containing noise and a plurality of different voices.

For the same reason, when waveforms having longer wavelengths, or lower frequencies, than the reference waveform are included in addition to the reference waveform, appropriate phase-distance relationship can never be maintained because a waveform having a longer wavelength can extend from a waveform section involving one wavelength of the reference waveform to its another waveform section. Thus, a channel intended for the reference waveform need be a channel where the lowest frequency component is present. In this respect, channel B is one where the lowest frequency component is present.

Modifying the first term of the right side of expression (18), the following expression is obtained:

$$\frac{\Delta\Theta_{i,k}}{\Delta t\cdot v}\cdot\left\{(\theta'_{i-1,B}-\theta_{i-1,B})\cdot\frac{\Delta t\cdot v}{\Delta\Theta_{i,B}}\right\} \tag{19}$$

A part of expression (19) in braces indicates a moving distance of the phase of reference channel B corresponding to ΔP in FIG. 4. In order to maintain the VPC, the phase of every channel need be shifted by distance ΔP. The phase can be obtained by dividing distance ΔP by sound velocity ν and then multiplying a resulting value by angular velocity ω. A part of expression (19) appearing before the open brace is used for this calculation.

The first term of the right side of expression (18) can be simply considered as a phase change quantity of each channel obtained by multiplying a change quantity of the phase of channel B (for the reference waveform) wrapped in the preceding frame by a ratio in frequency of that channel to channel B. This term maintains VPC over the range of from the first frame to the preceding frame, as described above.

The second term of the right side of expression (18) can be analyzed and expressed, using expression (16), as follows:

$$(\rho-1)\,\Delta\Theta_{i,k}=\rho\Delta\Theta_{i,k}-\Delta\Theta_{i,k}=\Delta\Theta'_{i,k}-\Delta\Theta_{i,k} \tag{20}$$

The second term indicates a change quantity of the phase occurring between the preceding and present frames and preserves HPC over the preceding and present frames. An added value of the second term and the first term represents a change quantity of the phase ranging from the first frame to the present frame between the original voice and the synthesized voice. Thus, phase θ' of the synthesized voice is calculated by adding the added value of the second term and the first term to phase θ of the present frame.

Phase θ' can be calculated in expression (18) by using, as a reference, unscaled phase values obtained in the present and preceding frames. Thus, even when an error occurs in any channel in the calculation of the phase, a bad influence that the error would otherwise exert on calculation of phase θ' in a subsequent frame is avoided or reduced. This also ensures that synthesized voice data good at all times is obtained.

Figure 5A:
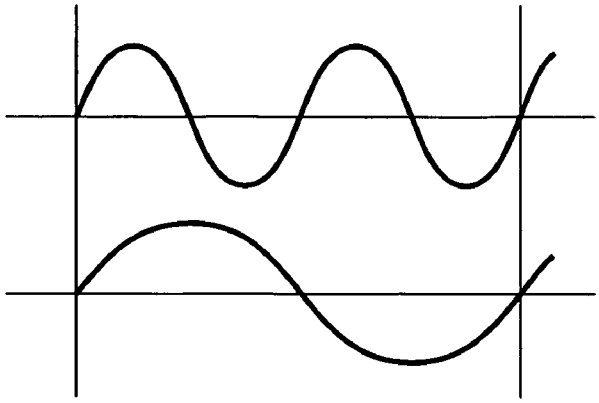
FIG. 5A illustrates a reference relationship in the phase between two channel waveforms.
Figure 5B:
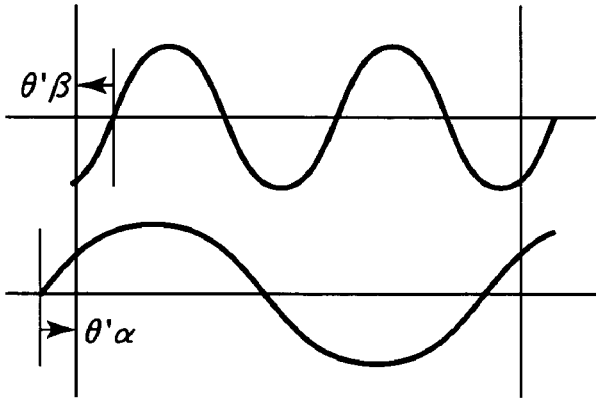
FIG. 5B illustrates a relationship in the phase between two channel waveforms in the prior art.
Figure 5C:
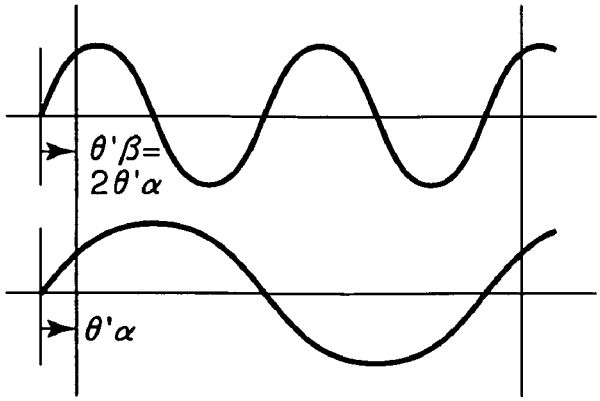
FIG. 5C illustrates a relationship in the phase between two channel waveforms in the embodiment.

FIG. 5 illustrates a relationship in the phase between frequency channels in a frame where a reference waveform and a second harmonic waveform are shown as an example. FIG. 5B illustrates a relationship in the phase between channels in a frame in the prior art where each channel phase $\theta'_{i,k}$ is calculated from expression (1). FIG. 5C illustrates a relationship in the phase between channels in a frame in the present embodiment where each channel phase $\theta'_{i,k}$ is calculated from expression (18). In FIGS. 5B and 5C, each relationship in the phase between channels is changed from the relationship in the phase of FIG. 5A.

In expression (1), the respective phases $\theta'_{i,k}$ are individually and independently calculated. Thus, as shown in FIG. 5B, a distance and a direction corresponding to phase $\theta'\alpha$ of the reference waveform in the frame do not always coincide with those corresponding to phase $\theta'\beta$ of the second-harmonic waveform in the frame. Thus, a phase discrepancy between the channels is accumulated inappropriately depending on calculated phase $\theta'$ of each channel, and VPC representing the phase relationship between channels is not preserved.

In contrast, as shown in FIG. 5C, in the present embodiment phase $\theta'\beta$ in the frame of the second-harmonic waveform is obtained by causing the phase to coincide with phase $\theta'\alpha$ in the preceding frame of the reference waveform. Thus, the distance and direction corresponding to the phase of the second-harmonic waveform coincide with those corresponding to the phase of the reference waveform. In this way, the phase difference between the original and synthesized voices in the frame is calculated with the reference waveform as a reference. Thus, phases $\theta'$ obtained in the respective channels have an appropriate phase relationship and VPC is preserved.

As described above, the voice analysis/synthesis apparatus of this embodiment always preserves VPC and HPC, thereby providing synthesized voice data that will be let off from speaker 12 as a sound that gives no impression of phase discrepancy.

Operation of the electronic musical instrument that realizes the voice analysis/synthesis apparatus will be described next with reference to flowcharts of FIGS. 7 and 8.

Figure 7:
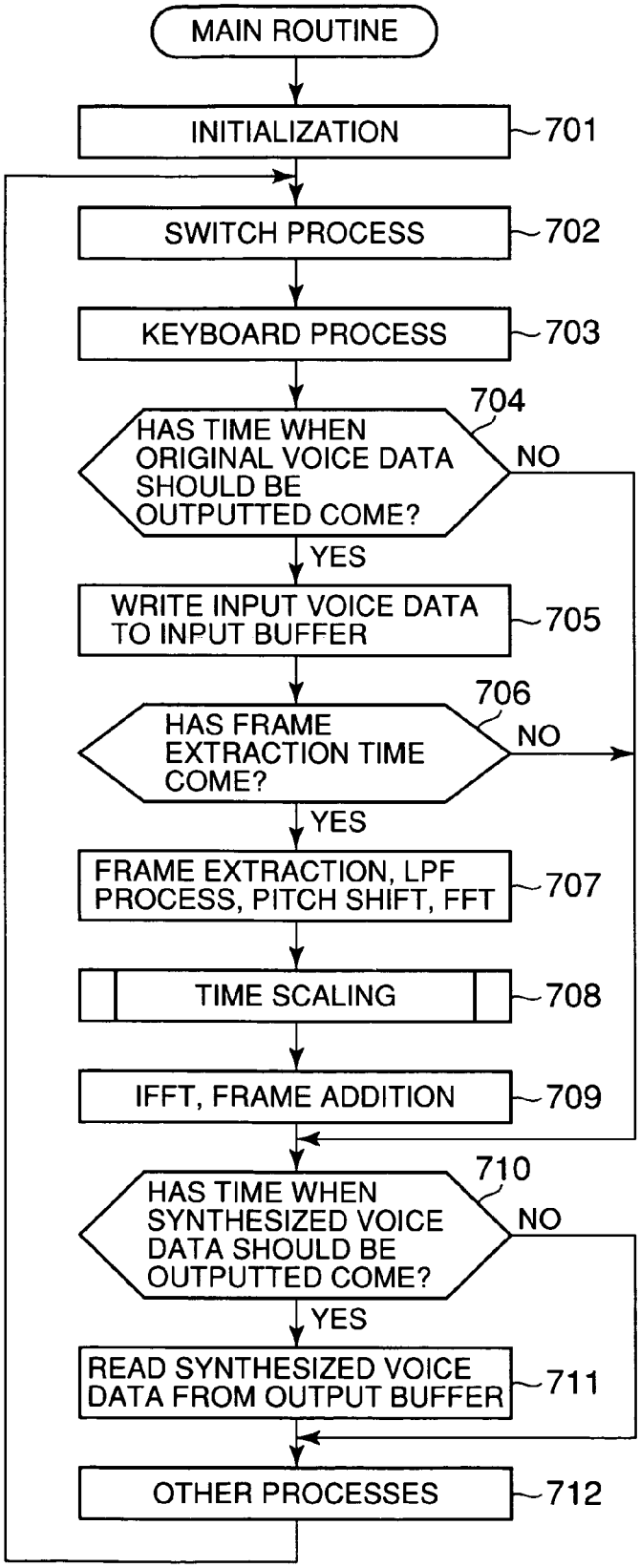
FIG. 7 is a flowchart of a whole voice analysis/synthesis process to be performed in the first embodiment.

FIG. 7 is a flowchart of indicative of the whole operation of the apparatus, which will be performed when CPU 1 executes the program stored in ROM 4 and uses resources of the musical instrument.

First, in step 701, an initializing process is performed when the power source is turned on. Then in step 702, a switch process is performed which corresponds to a user's operation on a switch of switch unit 3. More specifically, the switch process includes, for example, causing a detector of switch unit 3 to detect a status of each switch, receiving and analyzing a result of the detection and then specifying the type and status change of the operated switch.

In step 703, a keyboard process corresponding to the use's operation on keyboard 2 is performed. In this process, a musical sound is let off from speaker 12 in accordance with the user's operation on keyboard 2.

Then in step 704, it is determined whether it is now a sampling time when original voice data should be outputted from A/D converter 8. If so, the determination is YES and in step 705 the original voice data is written to input buffer 21 of RAM 5. Control then passes to step 706. Otherwise, the determination is NO and control then passes to step 710.

In step 706, it is determined whether it is a time when a frame should be extracted. When a time when the original voice waveform data for a hop size should be sampled has elapsed after the previous sampling time come, the determination is YES and control passes to step 707. Otherwise, the determination is NO and control then passes to step 710.

In step 707, one-frame original voice data section is extracted from the original voice data stored in input buffer 21 and then subjected to an LPF process that eliminates high frequency components, a pitch shift including interpolation/extrapolation or thinning out, and FFT in this order. Then in step 708, a time scaling process is performed on the frequency component of each channel obtained by FFT to calculate the phase of a synthesized voice in the frame. Then in step 709, the frequency component of each channel subjected to the time scaling process is subjected to IFFT and resulting synthesized voice data for one frame is then added in an overlapping manner to the synthesized voice data stored in output buffer 29 of RAM 5. Control then passes to step 710.

Frame extractor 22, LPF 23, pitch shifter 24 and FFT unit 25 of FIG. 2 are implemented by CPU 1 that performs step 707. Time scaling unit 26 is implemented by CPU 1 that performs step 708. IFFT unit 27 and frame addition unit 28 are implemented by CPU 1 that performs step 709.

In step 710, it is determined whether it is a time when synthesized voice data for one sample should be outputted. If so, the determination is YES and in step 711 the synthesized voice data to be outputted is read out from output buffer 29 and delivered via musical sound generator 9 to D/A converter 10. The data outputted from D/A converter 10 is then subjected to other required processing in step 712. Control then returns to step 702. If not, the determination becomes NO and the processing in step 712 is performed.

The synthesized voice data is then delivered via musical-sound generator 9 to D/A converter 10. To this end, musical-sound generator 9 has the function of mixing musical-sound waveform data generated thereby and data received externally.

Figure 8:
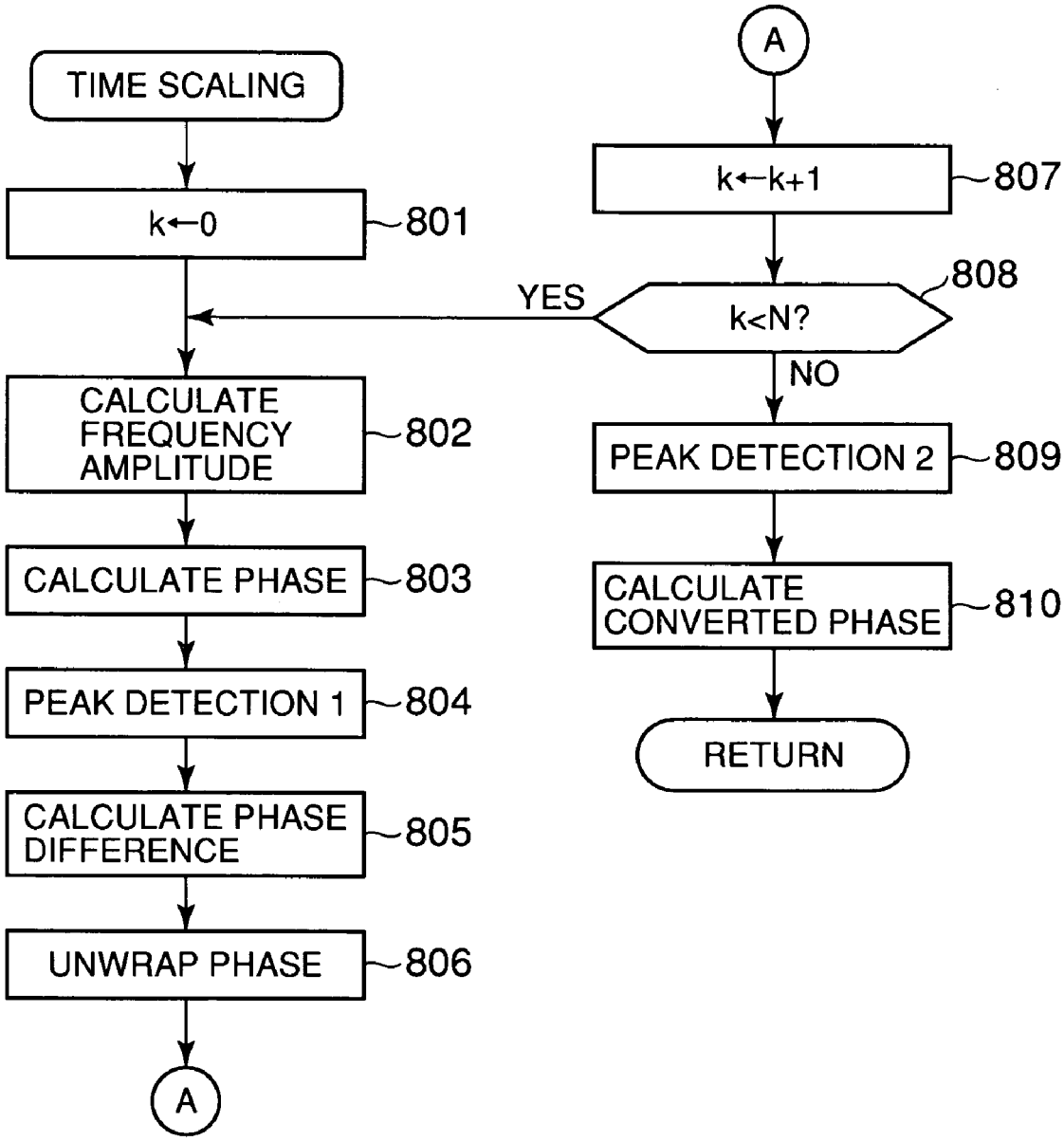
FIG. 8 is a flowchart of a time scaling process.

FIG. 8 is a flowchart of a time scaling process to be performed in step 708, which is will be described next. In the time scaling process, the frequency component of each frequency channel obtained by FFT is delivered to time scaling unit 26 of FIG. 2. The frequency component includes a real part and an imaginary part, as described above. Time scaling unit 26 is realized by CPU 1 that performs the scaling process.

First in step 801, 0 is substituted into a variable k that specifies a frequency channel to be noted. In step 802, a frequency amplitude (or formant component) is calculated from a frequency component of the channel specified by variable k. Let real and imaginary parts of the frequency component be real and img, respectively. Then, the frequency amplitude mag is given by $$mag=(real^2+img^2)^{1/2} \quad (21).$$

Then step 803, the phase is calculated from the frequency component as $$\text{phase } \theta=\arctan(img/real) \quad (22).$$

The phase has been wrapped.

In step 804, the channels in which the frequency components are present are searched for a peak one of frequency amplitudes mag although more precise peak detection is performed separately. More specifically, a particular channel whose frequency amplitude mag is larger than the frequency amplitudes mag of eight successive channels four of which are present before the particular channel and the other, four of which are present after the particular channel is detected as having a peak and registered. This process is repeated by selecting all the channels sequentially one at a time as a particular channel.

Then in step 805, a wrapped phase difference $\Delta\theta$ in the channel between the preceding and present frames is calculated from expression (4). Then in step 806, wrapped phase difference $\Delta\theta$ is unwrapped in accordance with expression (10), thereby obtaining phase difference $\Delta\Theta$.

Then in step 807, the value of variable k is incremented. Then in step 808, it is determined whether the value of variable k is smaller than the order of FFTs, N. When the frequency amplitudes mag in all the frequency channels have been calculated, the relationship k<N is not satisfied. Thus, the determination in step 808 is NO. Control then passes to step 809. If not, the determination is YES and control then returns to step 802. Thus, a processing loop including steps 802-808 is operated repeatedly until frequency amplitudes mag are calculated in all the frequency channels.

In step 809, the peak amplitude is detected more precisely than in step 804. This process, for example, includes extracting a frequency amplitude in a channel which is 14 db higher than a minimum one present before and after the former frequency amplitude. The value of −14 db as a criterion of the determination is set based on the amplitude characteristic of a Hanning window.

Expression (18) can be modified as $$\theta'_{i,k}=\Delta\Theta_{i,k}((\theta'_{i-1,B}-\theta_{i-1,B})/\Delta\Theta_{i,B}+(\rho-1)+\theta_{i,k} \quad (23)$$

All the phases indicated by the terms of the right side of the expression (23) as symbols will be prepared when the determination in step 808 becomes NO. Then, the peak detection in step 809 is performed to select channel B. Thus in step 810, a channel of the lowest frequency selected from among the peaks detected in step 809 is employed as channel B, and phase $\theta'$ of synthesized voice for each channel is calculated using expression (23).

Results of the calculations in steps 803 and 810 are preserved at least until a next frame comes. Thus, when the determination in step 808 becomes NO, all the phases indicated by the terms of the right side of expression (23) as the symbols will be prepared.

In step 709 of FIG. 7 to which control passes after execution of the time scaling process, the frequency component of each frequency channel is operated in accordance with phase $\theta'$ calculated in step 810, and then is subjected to IFFT. The operation of the frequency component on each frequency channel includes, for example, modifying the real and imaginary parts real and img without modifying the frequency amplitude mag such that a phase to be obtained from these parts coincides with phase $\theta'$. Thus, each frequency channel produces a synthesized waveform having phase $\theta'$ obtained in step 810.

While in the embodiment the pitch scaling and the time scaling are illustrated as performed, only the time scaling may be performed. While a synthesized voice based on its data is illustrated as let off, the original voice may be let off. Alternatively, both may be let off. In this case, synthesized voice data involving a pitch-shifted original voice can be used to let off a corresponding voice with a harmony effect. A plurality of items of synthesized voice data different in shift quantity may be synthesized to let off a voice with chord composing sounds. To this end, for example, the synthesized voice data stored in output buffer 29 and the original voice data stored in input buffer 21 may be added and resulting data may be delivered to D/A converter 10.

While the detection and determination of reference channel B are illustrated as performed by seeking a channel having the lowest frequency from among the channels extracted as having the peak amplitudes, a different method may be used to determine channel B.

Second Embodiment

When a pitch shift is performed in the pitch scaling process, the position (or frequency) of a formant of the synthesized voice shifts to a position (or frequency) different from that of the original voice, thereby giving an impression of an unnaturally sounding synthesized voice generally. Thus, the second embodiment involves preserving the formant of the original voice while performing the pitch scaling (or shifting) process, thereby producing a synthesized voice that we feel more natural.

A voice analysis/synthesis apparatus of the second embodiment includes an electronic musical instrument as in the first embodiment. The electronic musical instrument and hence the voice analysis/synthesis apparatus of the second embodiment have substantially the same structures as the first embodiment. Thus, the same reference numeral as used in the figures of the drawings to denote the component of the first embodiment is used to denote a similar element of the second embodiment in other figures of the drawings and further description of the like component will be omitted. Thus, parts of the second embodiment different from those of the first embodiment will be mainly described next.

Figure 9:
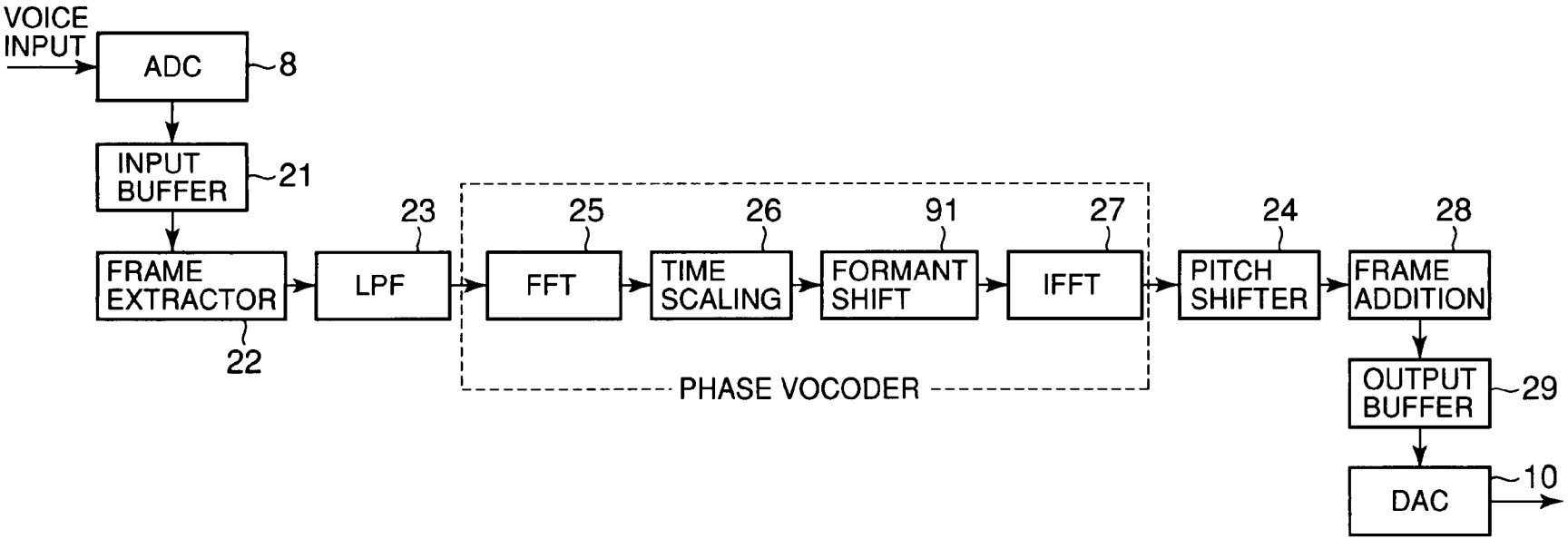
FIG. 9 illustrates a functional structure of a voice analysis/synthesis apparatus as a second embodiment.

Referring to FIG. 9, there is shown a functional structure of the voice analysis/synthesis apparatus of the second embodiment. Frame waveform data from which the high frequency component data is eliminated by LPF 23 is inputted to FFT unit 25. Then, time scaling unit 26 performs a time scaling process on an un-pitch-shifted frequency component of each frequency channel in a frame obtained by FFT.

If the value of a pitch scaling factor $\rho$ is a, the frequency is increased a-fold by pitch shifting, and conversely, the frame size of voice data increases 1/a-fold. In the second embodiment, original voice data for one frame is subjected to time scaling to increase the size of that data a-fold before pitch shifting such that voice (or synthesized voice) data for one frame remains original.

The frequency component for each frequency channel subjected to the time scaling is then delivered to formant shift unit 91, which beforehand shifts the formant so as to cancel a possible shift of the formant occurring in the pitch shifting. If the value of a pitch scaling factor $\rho$ is a, the formant is shifted by 1/a. The frequency component in each frequency channel subjected to such previous shifting of the formant is then delivered to IFFT unit 27, and then restored to voice data on the time coordinates by inverse FFT.

The number of items of the restored voice data for one frame on the time coordinates is different from that of the original data for one frame depending on the value of the pitch scaling factor $\rho$ due to the time scaling process performed by time scaling unit 26. Pitch shifter 24 interpolates/extrapolates or thins out such voice data depending on the value of pitch scaling factor $\rho$, thereby shifting the pitch of the voice data. Thus, interpolated/extrapolated or thinned-out voice data for one frame finally remains unchanged, or has the same frame size as the original voice data. This data is then delivered as synthesized voice data to frame addition unit 28 and then subjected to a proper addition process. Resulting synthesized voice data from addition unit 28 produces a natural voice that does not give an impression of phase discrepancy auditorilly because the formant of the original voice data is preserved.

Figure 10:
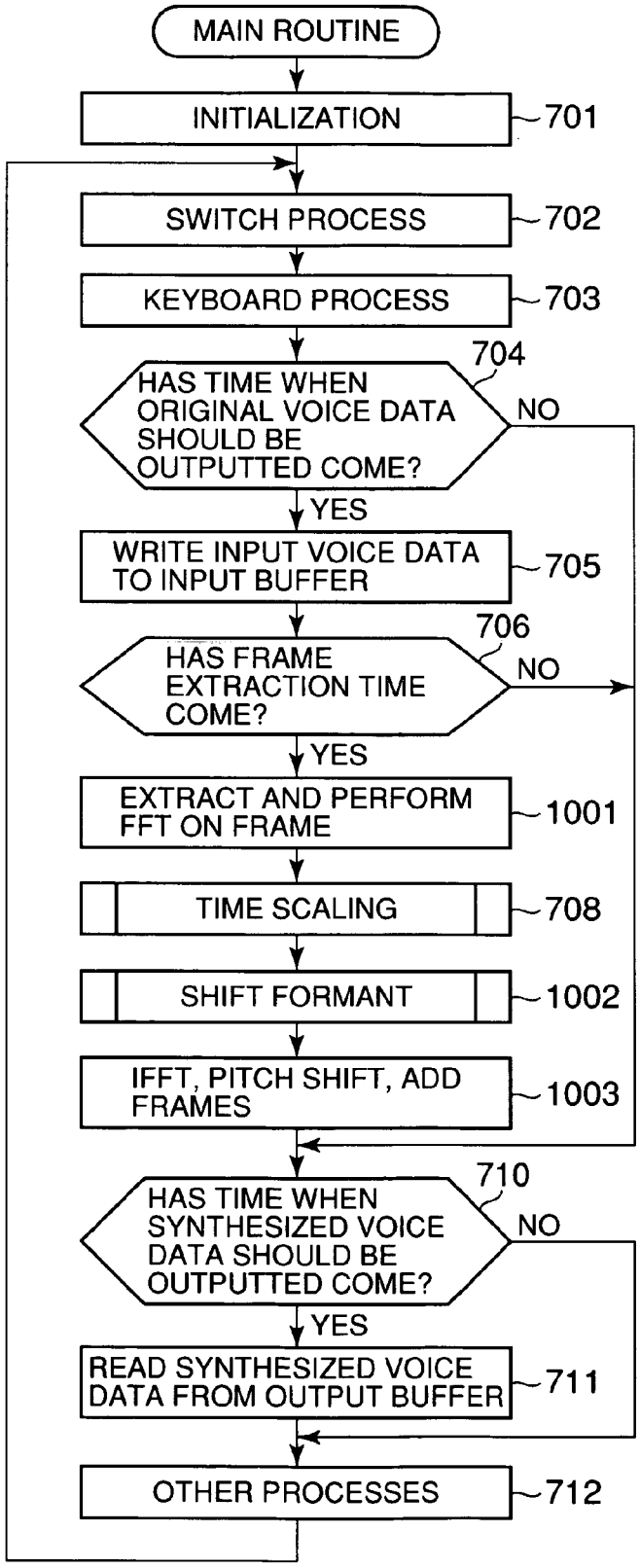
FIG. 10 is a flowchart of a voice analysis/synthesis process to be performed in the second embodiment.

Referring to FIG. 10, the whole process to be performed by the second embodiment will be described in detail.

In the second embodiment, when determination in 706 is YES, control passes to step 1001 where original voice data for one frame is extracted from input buffer 21 and subjected to an LPF process that eliminates the high frequency components and an FFT process in this order. Control then passes to step 708 where a time scaling process of FIG. 8 is performed on the data subjected to the FFT process.

Then in step 1002, a formant shifting process is performed which shifts the formant of the original voice for preserving purposes. Then in step 1003, the frequency component of each channel operated in the formant shifting process is subjected to an IFFT process, voice data for one frame obtained in the IFFT process is pitch shifted by interpolation/extrapolation or thinning-out thereof, and then resulting synthesized voice data for one frame is added in an overlapping manner to the synthesized voice data stored in output buffer 29 of RAM 5. Then, control passes to step 710.

In the second embodiment, pitch shifter 24 is implemented by CPU 1 that performs step 1003. Formant shifter 91 is implemented by CPU 1 that performs step 1002.

Figure 11:
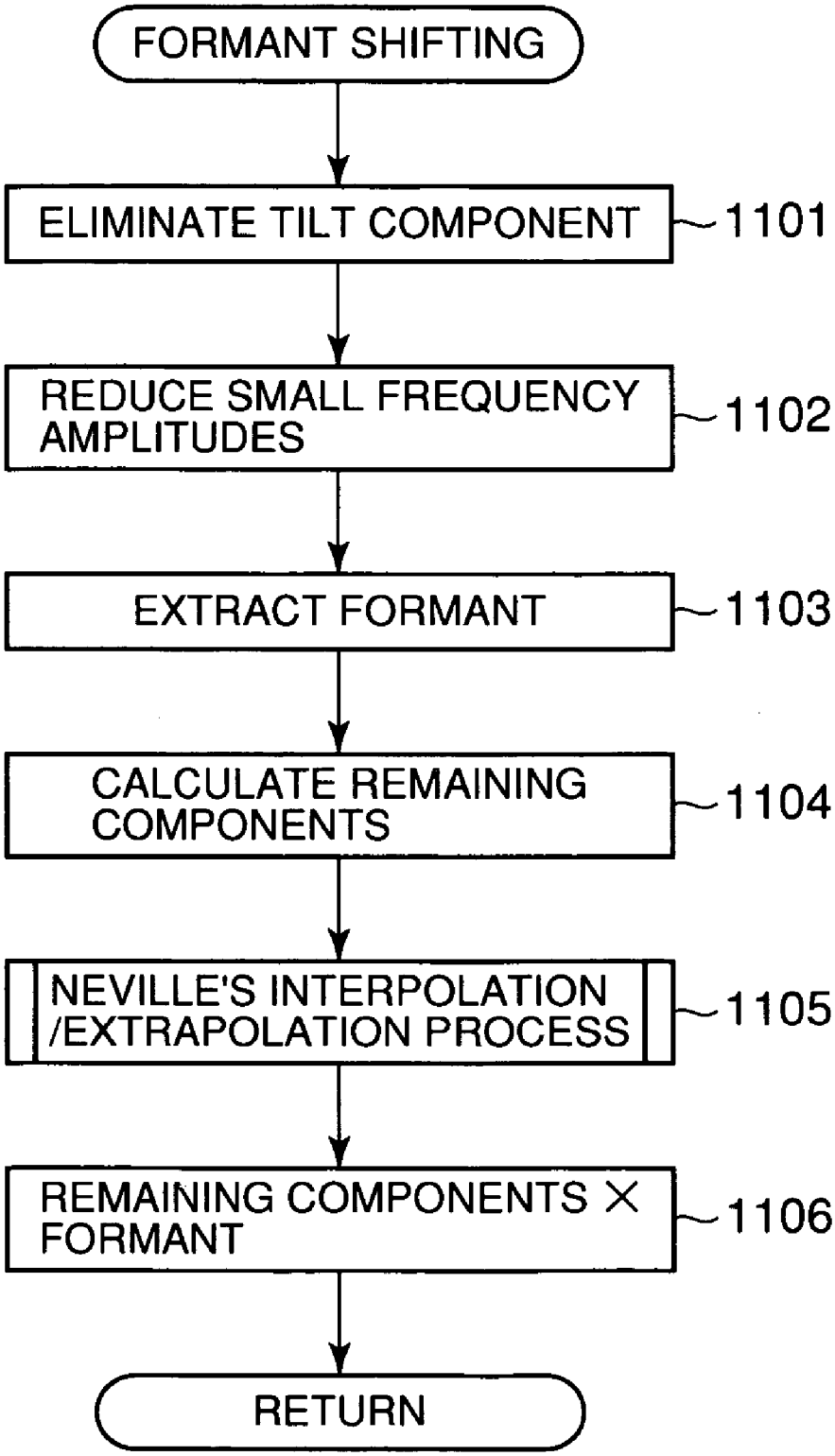
FIG. 11 is a flowchart of a formant shift process.

Referring to FIG. 11, the formant shifting process to be performed in step 1002 will be described in detail.

First in step 1101, a tilt component including an inclination of the frequency characteristic of a vocal-cords sound source signal is eliminated from a frequency amplitude mag (shown in expression (21)) of each channel. It is known that the frequency characteristic of a remaining signal, obtained by generally eliminating the influence of a resonant frequency based on the formant from a voice signal, or a vocal-cords voice source signal, tends to attenuate gently as the frequency increases. The frequency characteristic of the voice signal comprises the characteristic of a resonant frequency based on the formant on which the tilt component is superimposed. Thus, when only the formant component is extracted, the tilt component need be eliminated.

As described above, the frequency characteristic of the vocal-cords sound source signal generally tends to attenuate gently as the frequency increases. Thus, the voice data need be passed through a high pass filter (HPF) of approximately first-order pass characteristic. After FFT, the frequency amplitude mag of each channel may be multiplied by a value that changes, for example, like a curve of a ¼ period sinusoidal wave.

The shift of the formant can emphasize noise or a frequency component leaking from a channel where the frequency component is present. This would produce a noisy or unnaturally sounding synthesized voice. Thus, after elimination of the tilt component in step 1102, frequency amplitudes mag smaller than a given value are regarded as noise and reduced.

In the present embodiment, the frequency amplitudes amg that is −58 db or more lower than the maximum value of the frequency amplitude amg are further attenuated by 26 db. Thus, all frequency amplitudes amg smaller than the given value are increased 0.05-fold. By performing this process as a preprocess, emphasis of noise is avoided even when the formant is shifted, thereby obtaining a good result securely. The reason why such preprocess is performed, or all frequency amplitudes amg lower than the give value are not reduced to 0, is that otherwise, a resulting synthesized voice would be felt unnatural. Accordingly, frequency amplitude amg that should not be emphasized is attenuated so as to cancel the emphasis of the frequency amplitude by the formant.

While frequency amplitude amg to be attenuated is determined based on its maximum value as a reference, a fixed value may be employed as the reference. The range of frequency amplitudes amg to be attenuated may be determined as required. This applies also to a degree of attenuating the frequency amplitude concerned.

In step 1103, a formant is extracted from the frequency amplitude amg of each channel subjected to the pre-process in a moving average filtering process as follows:

$$F_k = \frac{1}{M}\sum_{m=0}^{M-1} A_{k-m} \tag{24}$$

where A is the frequency amplitude, k is the channel, F is the formant, and M is the order of a moving average filter simulated in the moving average filtering process.

By performing the moving average filtering process, a rough form of a formant for each channel is extracted, thereby specifying the formant. The reason for this is to avoid extraction of frequency amplitude mag as a formant protruding from the other frequency amplitudes, for example, due to noise. In other words, it is for extracting a formant appropriately.

An order to be used in the moving average filter need be heeded. When the original voice has a high pitch, an interval of frequency between channels or spectra is large. Thus, a moving average filter of a low order M is inappropriate to extract a rough form of the formant and the original spectrum will exert a large influence on the rough form of the formant to be extracted. Thus, a moving average filter of a necessary and sufficient high order M is should be used.

Conversely, when the original voice has a low pitch, the interval of frequency between channels or spectra is narrow and close. In this case, use of a moving average filter of a high order M would crush the form of the formant, thereby making it impossible to extract the rough form of the formant appropriately. Thus, the order M need be reduced to such an extent that the rough form of the formant is not crushed.

Original voices having various pitches will be inputted to microphone 7. Thus, in the present embodiment order M is set to an appropriate value for the original voice as required. More specifically, an order M is determined based on the form of a peak of frequency amplitude mag detected by performing the time scaling process in step 708. Much more specifically, let the base channel determined in step 810 be k. Then, an order M is set which is shown by the following expression in accordance with which a good result was obtained experimentally:

$$M=\mathrm{Int}(k+3) \tag{25}$$

where symbol "Int" of expression (25) represents that an integer part of a result of bracketed calculation should be employed. Thus, when M>32, M=32 is set and when M<8, M=8 is.

Calculation or setting of order M in expression (25) is performed before the moving-average filtering process, thereby allowing the moving-average filtering process to be performed at all times with appropriate order M depending on the pitch of the original voice. Thus, the formant can be extracted appropriately at all times. Alternatively, the order M may be set depending on the number of peaks of the frequency amplitudes amg: that is, as the number of peaks increases, order M may be set to a lower one whereas the number of peaks decreases, order M may be set to a higher one.

After (the rough form of) the formant is extracted in the moving-average filtering process, control passes to step 1104 where the frequency amplitude amg of each channel is divided by the extracted formant. A result of the division corresponds to expression of a frequency region of the remaining components in a linear predictive coding analysis.

In step 1105, Neville's interpolation/extrapolation process is performed to shift the extracted formant. Then, control passes to step 1106 where the remaining components of each channel is multiplied by the shifted formant. Then, the formant shifting process ends.

By the multiplication, the frequency component present after the formant was shifted is obtained. The shifted formant is returned to its original position by pitch shifting in step 1003, thereby preserving the formant.

Figure 12:
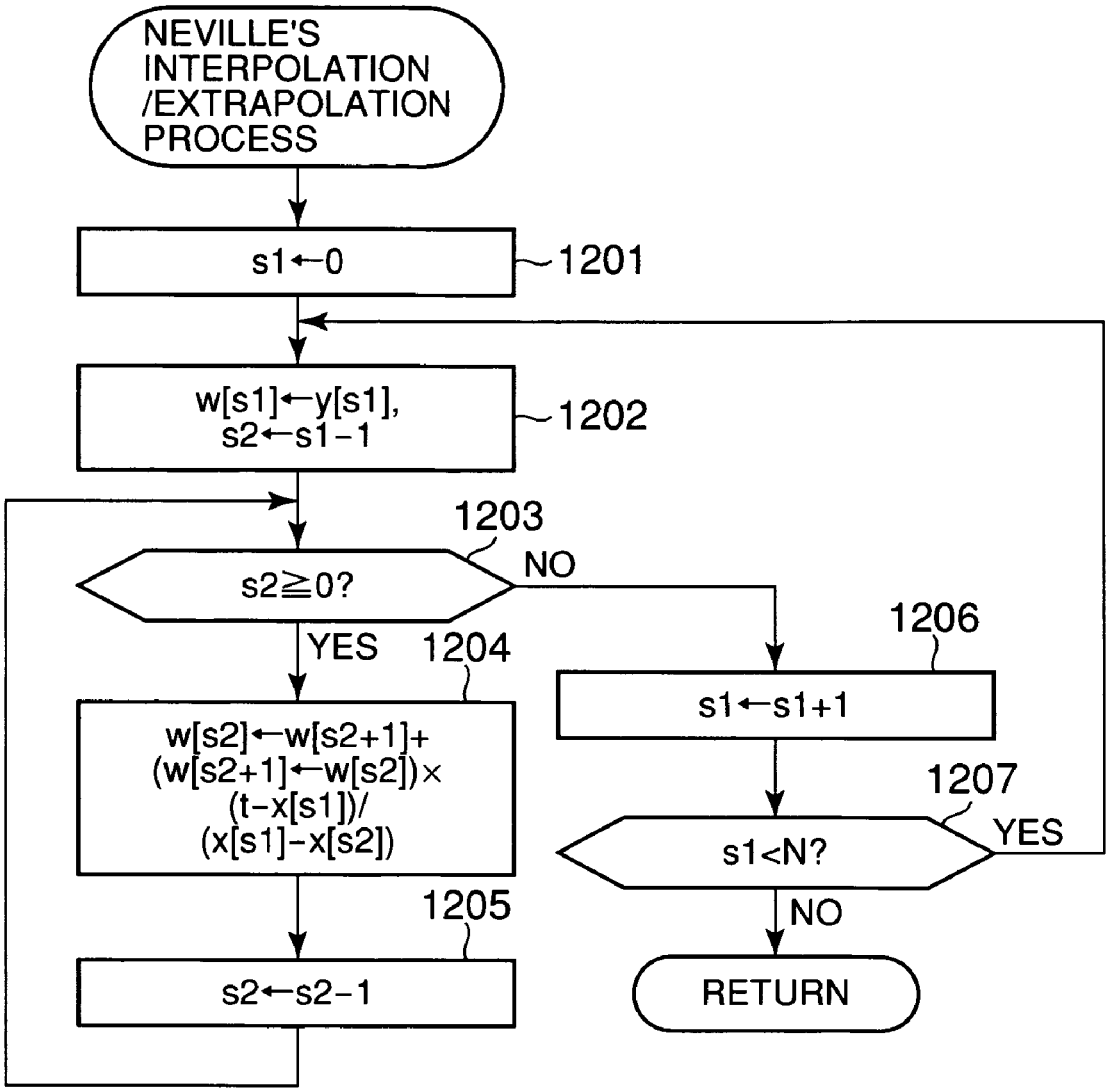
FIG. 12 is a flowchart of Neville's interpolation/extrapolation algorithm.

Referring to FIG. 12, Neville's interpolation/extrapolation process to be performed in step 1105 will be described. The frequency amplitude (or formant component) of each channel of a formant extracted in step 1103 is substituted along with the frequency corresponding to the channel into arrangement variables y and x and then preserved. The number of (for example, 4) formant components to be used in the interpolation/extrapolation process is substituted into variable N. A frequency (or channel) to which each formant component should be shifted is calculated based on the frequency involving the unshifted formant and the value of pitch scaling factor ρ. The formant component for the calculated frequency is calculated by referring to the values of the frequency amplitudes and corresponding frequencies substituted into the respective components of N pairs of arrangement variables y and x around the calculated frequency. Neville's interpolation/extrapolation process of FIG. 12 illustrates calculation of a formant component based on a frequency to which the formant is shifted.

First in step 1201, zero (0) is substituted into variable s1. Then in step 1202, a value of element y [s1] specified by a value of variable s1 of arrangement variable y is substituted into element w [s1] specified by a value of variable s1 of arrangement variable w, and a value representing a value of variable s1 minus 1 is then substituted into variable s2. Then in step 1203, it is determined whether the value of variable s2 is 0 or more. If not, the determination is NO and then control passes to step 1206. Otherwise, the determination is YES and then control passes to step 1204.

In step 1204, a value calculated in the following expression (26) is substituted into element w [s2]:

$$w[s2]=w[s2+1]+(w[s2+1]-w[s2])\times(t-x[s1])/x[s1]-x[s2]) \quad (26)$$

Then in step 1205, the value of variable s2 is decremented and control then returns to 1203.

When the determination in step 1203 is NO, control passes to step 1206 where the value of variable s1 is incremented. Then in step 1207, it is determined whether the value of variable s1 is smaller than variable N. If so, the determination is YES and control returns to step 1202. Otherwise, the determination is NO and this process ends.

As described above, the value of variable s1 is incremented sequentially while the value of element y [s1] is substituted into element w [s1] for updating purposes. As a result, a formant component at a variable t is finally substituted into element w [0]. In the processing of FIG. 12, variable t that coincides with the value of the frequency of the channel after the formant shift is obtained and the series of steps of FIG. 12 is performed, using N formant components around variable (or frequency) t. The value of variable (or frequency) t is sequentially changed in correspondence to a respective channel, at which time the processing of FIG. 12 is performed, thereby calculating all the formant components for the frequencies to be shifted.

The formant components to be calculated for the frequencies to be shifted are basically obtained by interpolating/extrapolating or thinning out the extracted formant. The formant component need not be calculated so accurately and linear interpolation/extrapolation may be employed. Instead of Neville's interpolation/extrapolation formula, another interpolation/extrapolation formula such as Lagrange's interpolation or Newton's interpolation/extrapolation formula may be employed.

While in the second embodiment a pitch shift is illustrated as performed after the time scaling, they may be performed in inverse order. However, in this case the original voice waveform is changed before the time scaling. Thus, changing the voice waveform will exert an influence on detection of a peak one of the frequency amplitudes mag. Thus, in order to preserve the formant better, a pitch shift is preferably performed after the time scaling.

While the formant is shifted for preserving itself even when the pitch is shifted, the formant may be shifted irrespective of the pitch shift, for example, in order to alter the voice quality. The pitch-sifted synthesized voice may be let off along with the original voice.

Programs that perform the functions of the voice analysis/synthesis apparatus or its modifications mentioned above may be recorded and distributed in recording media such as CD-Rs, DVDs or magneto-optimal disks. Alternatively, part or all of those programs may be distributed via a transmission medium used in the public network or the like. In this case, the user can acquire the respective programs and load them on a data processing apparatus such as a computer, thereby realizing a voice analysis/synthesis apparatus to which the present invention is applied. Thus, the recording media may be accessed by devices that distribute the programs.

Various modifications and changes may be made thereto without departing from the broad spirit and scope of this invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

What is claimed is:

1. A voice analysis/synthesis apparatus that analyses a first voice waveform and synthesizes a second voice waveform using a result of the analysis, the apparatus comprising:

a frequency analyzing unit for analyzing frequencies of the first voice waveform in units of a frame and for extracting a frequency component for each frequency channel;

a phase calculating unit for calculating a phase difference in a frame between the first and second voice waveforms, the frame preceding a present frame by a predetermined number of frames, wherein the phase difference is calculated based on a quantity of change in a phase between the first and second voice waveforms and having occurred while the first and second voice waveforms moved from a first frame to the preceding frame, with a predetermined one of the frequency channels as a standard, and based on a quantity of change in the phase between the first and second voice waveforms and having occurred while the first and second voice waveforms moved from the preceding frame to the present frame, and wherein the phase calculating unit is also for calculating a phase of the second voice waveform in the present frame by referring to the frequency components each extracted by the frequency analyzing unit for a respective frequency channel, and by using the phase difference; and a voice synthesizing unit for: (i) extracting a formant of the first voice waveform from the frequency components each extracted from the respective frequency channel by the frequency analyzing unit, (ii) operating the extracted frequency components to shift the extracted formant, (iii) converting the frequency component for each frequency channel in accordance with the phase calculated by the phase calculating unit, and (iv) synthesizing the second voice waveform in units of a frame, using the converted frequency components.

2. The voice analysis/synthesis apparatus of claim 1, wherein the phase calculating unit calculates the phase of the second voice waveform in the present frame for each of the frequency channels based on the phase difference, the phase change quantity between the first and second voice waveforms having occurred from the preceding frame to the present frame, and a phase of a first voice waveform in the present frame.

3. The voice analysis/synthesis apparatus of claim 1, wherein the preceding frame comprises a frame immediately preceding the present frame and the predetermined frequency channel comprises a frequency channel having a lowest frequency among those having the frequency components.

4. The voice analysis/synthesis apparatus of claim 1, wherein the voice synthesizing unit synthesizes the second voice waveform with an overlap factor different from that used in the frequency analyzing unit.

5. The voice analysis/synthesis apparatus of claim 1, wherein the second voice waveform comprises a pitch-shifted version of the first voice waveform.

6. The voice analysis/synthesis apparatus of claim 1, wherein the voice synthesizing unit obtains a frequency amplitude from the frequency component for each frequency channel and extracts the formant of the first voice waveform by performing a filtering process on the frequency amplitude.

7. The voice analysis/synthesis apparatus of claim 6, wherein the voice synthesizing unit changes an order to be used in the filtering process, as required, based on a shape of the frequency amplitude calculated for a given frequency channel.

8. The voice analysis/synthesis apparatus of claim 1, wherein the voice synthesizing unit further reduces a frequency amplitude having a value smaller than a predetermined value calculated from the frequency component.

9. The voice analysis/synthesis apparatus of claim 1, wherein the apparatus outputs the first voice waveform and the second voice waveform synthesized by the voice synthesizing unit.

10. A computer readable medium having stored thereon a program for a voice analysis/synthesis apparatus that analyzes a first voice waveform and synthesizes a second voice waveform using a result of the analysis, the program causing a computer of the voice analysis/synthesis apparatus to perform functions comprising:

analyzing frequencies of the first voice waveform in units of a frame and extracting a frequency component for each frequency channel;

calculating a phase difference in a frame between the first and second voice waveforms, the frame preceding a present frame by a predetermined number of frames, wherein the phase difference is calculated based on a quantity of change in a phase between the first and second voice waveforms and having occurred while the first and second voice waveforms moved from a first frame to the preceding frame, with a predetermined one of the frequency channels as a standard, and based on a quantity of change in the phase between the first and second voice waveforms and having occurred while the first and second voice waveforms moved from the preceding frame to the present frame, calculating a phase of the second voice waveform in the present frame by referring to the extracted frequency components for a respective frequency channel, and by using the phase difference;

extracting a formant of the first voice waveform from the frequency components each extracted from the respective frequency channel;

operating the extracted frequency components to shift the extracted formant;

converting the frequency component for each frequency channel in accordance with the calculated phase; and synthesizing the second voice waveform in units of a frame, using the converted frequency components.

* * * * *